US008808583B2

(12) United States Patent
Yu et al.

(10) Patent No.: US 8,808,583 B2
(45) Date of Patent: Aug. 19, 2014

(54) METHOD FOR MANUFACTURING CONDUCTIVE ADHESIVE CONTAINING ONE-DIMENSIONAL CONDUCTIVE NANOMATERIAL

(75) Inventors: Yi-Hsiuan Yu, Taoyuan County (TW); Bao-Yann Lin, Hsinchu County (TW); Ming-Hsiung Wei, Taoyuan County (TW); Lea-Hwung Leu, Taipei (TW); Gou-Hong Yiin, Taipei County (TW); Chen-Chi M Ma, Hsinchu (TW)

(73) Assignee: Chung Shan Institute of Science and Technology Armaments Bureau, M.N.D., Taoyuan County (TW)

( * ) Notice: Subject to any disclaimer, the term of this patent is extended or adjusted under 35 U.S.C. 154(b) by 457 days.

(21) Appl. No.: 12/827,093

(22) Filed: Jun. 30, 2010

(65) Prior Publication Data

US 2012/0001130 A1 Jan. 5, 2012

(51) Int. Cl.
*H01B 1/22* (2006.01)
*H01B 1/20* (2006.01)

(52) U.S. Cl.
USPC ..... 252/514; 252/512; 252/513; 252/500; 977/742

(58) Field of Classification Search
USPC ..... 252/514, 512, 513, 500; 977/742
See application file for complete search history.

(56) References Cited

U.S. PATENT DOCUMENTS

| | | | | |
|---|---|---|---|---|
| 6,741,019 | B1 * | 5/2004 | Filas et al. | 313/355 |
| 7,632,425 | B1 * | 12/2009 | Simone et al. | 252/182.3 |
| 7,645,497 | B2 * | 1/2010 | Spath et al. | 428/1.4 |
| 7,955,528 | B2 * | 6/2011 | Chung et al. | 252/512 |
| 8,043,800 | B2 * | 10/2011 | Naoi | 430/564 |
| 8,094,247 | B2 * | 1/2012 | Allemand et al. | 349/12 |
| 8,174,667 | B2 * | 5/2012 | Allemand et al. | 349/187 |
| 8,540,899 | B2 * | 9/2013 | Miller | 252/500 |
| 2008/0143906 | A1 * | 6/2008 | Allemand et al. | 349/43 |
| 2011/0070404 | A1 * | 3/2011 | Naoi | 428/156 |
| 2011/0096388 | A1 * | 4/2011 | Agrawal et al. | 359/268 |
| 2011/0297642 | A1 * | 12/2011 | Allemand et al. | 216/13 |
| 2012/0031460 | A1 * | 2/2012 | Hosoya et al. | 136/244 |
| 2012/0094090 | A1 * | 4/2012 | Yamazaki et al. | 428/195.1 |
| 2012/0107598 | A1 * | 5/2012 | Zou et al. | 428/292.1 |

FOREIGN PATENT DOCUMENTS

WO WO 2010003138 A1 * 1/2010

* cited by examiner

*Primary Examiner* — Douglas McGinty
(74) *Attorney, Agent, or Firm* — Rosenberg, Klein & Lee

(57) ABSTRACT

A method for manufacturing a conductive adhesive containing a one-dimensional (1D) conductive nanomaterial is revealed. The method produces a conductive adhesive by mixing the 1D conductive nanomaterial with water-based or solvent-based resin solution. The conductive adhesive has good industrial applications, not influenced by industrial adaptability and environmental adaptability. The conductive adhesive obtained also has better conductivity. Moreover, the amount of the 1D conductive nanomaterial used in the present invention is less than the amount of conductive nanoparticles used and the cost is reduced effectively.

6 Claims, 7 Drawing Sheets

METHOD FOR MANUFACTURING CONDUCTIVE ADHESIVE CONTAINING ONE-DIMENSIONAL CONDUCTIVE NANOMATERIAL

BACKGROUND OF THE INVENTION

1. Fields of the Invention

The present invention relates to a method for manufacturing a conductive adhesive, especially to a method for manufacturing a conductive adhesive containing a one-dimensional (1D) conductive nanomaterial.

2. Descriptions of Related Art

One-dimensional (1D) nanostructures have low-dimensional physical and electronic transport properties and have been regarded as the most promising materials with features different from those of bulk materials due to its special structure in the last 10 years. One-dimensional (1D) nanostructures include nanowires, nanotubes, nanorods, nanopillars, nanofibrils, and quantum wires. 1D nanostructure is applied to nanoelectronic devices and functional components such as ultra-thin and full-color LED, printing equipment, field emission display (FED), low energy consumption nanowire LED, ammonia ($NH_3$) sensors, hydrogen ($H_2$) sensors, etc.

Nano-metal materials such as gold, tin, silver, platinum etc. have good electrical conductivity so that they are applied to interconnect materials. 1D metal nanomaterials are with unusual properties in the fields of optics, electricity, magnetism and chemistry. 1D metal nanomaterials have connected zero-dimensional metal nanomaterials in series so that 1D metal nanomaterials are with better electrical conductivity compared with zero-dimensional metal nanomaterials. Due to two kinds of dimensions of the nanomaterials, 1D metal nanomaterials still keep their unique nanoscale properties such as high activity, low sintering temperature, tunnelling effect etc. Thus 1D metal nanomaterials have broad applications such as Ultra Large Scale Integration (ULSIC) and optical conductive fiber. Metal nanowires that match with nanodots are used for connecting electronic parts so as to achieve high density arrangement in nanoscale electronics. Magnetic metal nanowires with good vertical magnetization are used as high density vertical magnetic recording materials. Quantum magnetic disks produced by template synthesis are used as nanoelectrode ensembles, applied to trace detection and gas sensors in the field of electrochemistry analysis.

Silver is the best conductive metal and is applied to coating material such as conductive silver paste with features of high electrical conductivity, stretchability, salt mist corrosion durability, and wide applicable temperature range. For further applications in electrical conductivity after nanolization, 1D silver nanowire is synthesized. 1D wire-like nanostructure has features of a good conductivity and lower temperature sintering. It is applied to electrodes, low temperature sintered conductive adhesives, superconductive thick film circuit, microwave absorbing materials, and electromagnetic wave absorbing materials and the amount of silver used is dramatically reduced.

As to the one dimensional conductive nanomaterials, carbon nanotube is the only commercial product available on the market now. For higher conductivity, metal materials such as silver or copper should be used. However, the mass production of silver or copper nanowires has not matured yet and the product is quite expensive. Thus there is a need to develop related techniques and metal materials are a new generation of materials.

1D silver nanostructures are mainly applied to electrical conductivity and biochemistry fields. For electrical conductivity, 1D silver nanostructures are prepared to form a transparent conductive film for electrode connection of semiconductors, solar cells and light emitting diode (LED) or are used in conductive coating for micro-electronic components and displays.

The applications of 1D silver nanostructures in biochemistry mainly includes biological microsensors and self-assembled DNA sensors. 1D conductive nanomaterial applied to transparent conductive films is mainly produced by precision etching. Catalyst is implanted by vapor deposition and then 1D silver nanostructures can grow into a network microstructure. Or 1D silver nanostructures are synthesis firstly by electrochemical etching template growth or wet chemical synthesis and then is arranged again. Yet the ways of arrangement are quite complicated. For example, the 1D silver nanostructures are produced by filtering, deposition and drying and then to form a film by micro-transfer printing technology. Or the film is produced by microscope probes or high temperature sintering. These ways are not proper for mass production and there are many restrictions on the substrate. The manufacturing cost is quite high. These are all opposite to the industrial mainstream-coating processes.

After being mixed with resin, nano silver can be coated directly and cured at low temperature. Refer to two related techniques, Chinese Patent. App. No. 10154638, silver nanowires are prepared by wet chemical synthesis. After purification and drying, the silver nanowires are mixed with epoxy resin or phenolic resin to be coated and a film is formed. As to Chinese Patent. App. No. 10050523, a conductive adhesive is formed by silver nanowires and acrylic resin. Then the conductive adhesive is coated. Although the above two patents report good conductivity of the conductive adhesive and the conductive film, the incompatibility between aqueous solution containing silver nanowires and solvent-based resin has not been discussed. Aggregation occurs while mixing nanomaterials with different surface properties and poor-dispersed conductive medium is unable to connect and form an electric circuit. Thus the dispersion is a main bottleneck in the technology of enhancing conductivity of nanomaterials, especially the silver nanowires with good conductivity. The present invention provides a method for manufacturing a conductive adhesive containing one-dimensional conductive nanomaterials. The conductive adhesives obtained according to the present invention have good conductivity. Moreover, the amount of conductive material used is dramatically reduced and the manufacturing processes are simplified.

SUMMARY OF THE INVENTION

Therefore it is a primary object of the present invention to provide a method for manufacturing a conductive adhesive containing a one-dimensional (1D) conductive nanomaterial. A conductive adhesive is produced by mixing the 1D conductive nanomaterial with water-based or solvent-based colloid. The conductive adhesive has good industrial applications, not influenced by industrial adaptability and environmental adaptability. The conductive adhesive also has better conductivity.

It is another object of the present invention to provide a method for manufacturing a conductive adhesive containing a 1D conductive nanomaterial. The conductive adhesive obtained by the present invention has better conductivity. Moreover, the cost is reduced effectively because that less amount of 1D conductive nanomaterial is used.

In order to achieve above objects, a method for manufacturing a conductive adhesive containing a 1D conductive nanomaterial according to the present invention includes following steps. Add and disperse one conductive nanomaterial into ethanol to form a nanosacle dispersing solution. The conductive nanomaterial is in the form of nanowires, nanotubes, nanorods, or conductive material with 1D nanostructure. Then add a modification solution into the nanosacle dispersing solution to form a mixed solution. Stir and heat the mixed solution. Add a resin solution into the mixed solution and mix the mixed solution and the resin solution evenly to produce a conductive adhesive. Next modify rheological properties of the conductive adhesive obtained.

Another method for manufacturing a conductive adhesive containing a 1D conductive nanomaterial according to the present invention includes following steps. Add and disperse one conductive nanomaterial into ethanol to form a nanosacle dispersing solution. The conductive nanomaterial is in the form of nanowires, nanotubes, nanorods, or conductive material with 1D nanostructure. Then add a resin solution into the nanosacle dispersing solution, stir the nanosacle dispersing solution and the resin solution to mix evenly and get a colloidal mixture. Heat and concentrate the colloidal mixture so as to get a conductive adhesive.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
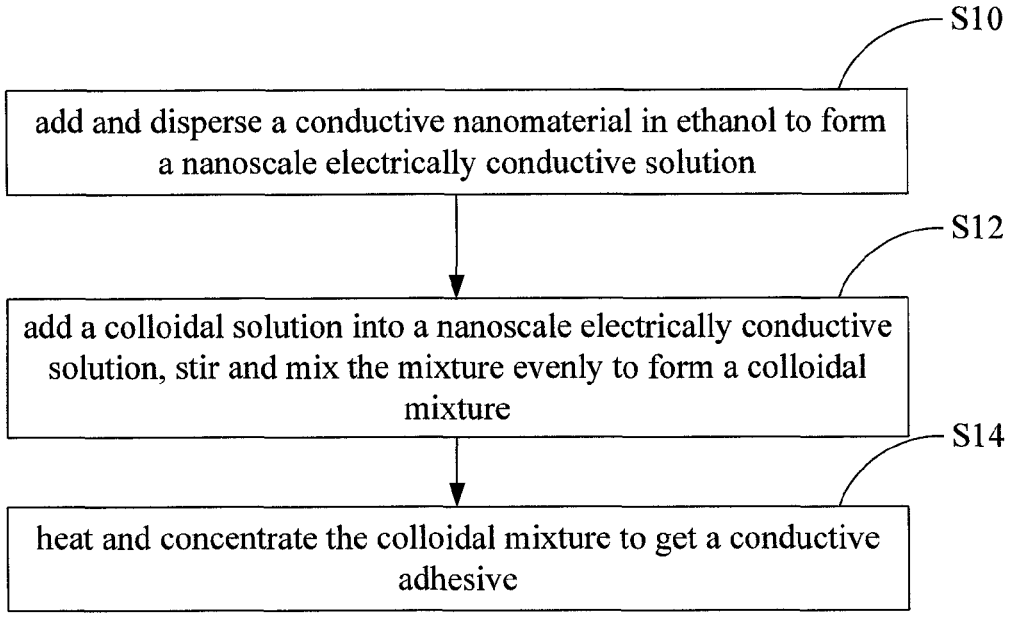
FIG. 1 is a flow chart of an embodiment according to the present invention.

Refer to FIG. 1, a flow chart of an embodiment of the present invention is revealed. The present invention provides a method for manufacturing a conductive adhesive containing a one-dimensional (1D) conductive nanomaterial. The conductive adhesive is formed by mixing an ethanol solution containing a conductive nanomaterial with a resin solution containing water-based resin. At first, run the step S10, add and disperse a conductive nanomaterial in ethanol to form a nanoscale dispersing solution. The conductive nanomaterial is selected from silver, gold, copper, iron, nickel, tin, electrically conductive metal or electrically conductive metal oxide. The conductive nanomaterial can be in the form of nanowires, nanorods, nanopillars, or conductive materials with 1D nanostructure.

Then take the step S12, add a resin solution into a nanoscale dispersing solution, stir and mix the mixture evenly to form a colloidal mixture. The resin solution is formed by mixing water based resin with an aqueous solution. Lastly, run the step S14, heat and concentrate the colloidal mixture to get a conductive adhesive. The following embodiments are conductive adhesives formed by mixing a conductive nanomaterial with a resin solution containing water-based resin.

Embodiment One

In accordance with above steps, a conductive adhesive is produced. In this embodiment, the conductive nanomaterial is silver and the conductive nanomaterial is in the form of nanowire. The water based resin of the resin solution is PVA (polyvinyl alcohol). Back to FIG. 1, a method for manufacturing a conductive adhesive of the present invention includes the following steps. In the beginning, take the step S10, add and disperse 100 g conductive nanomaterial (sivler nanowires) into ethanol to produce nanoscale dispersing solution in which the solid silver content is 5% by weight. While adding the conductive nanomaterial into ethanol, the dispersion is enhanced in an ultrasonic tank for about 20 minutes.

Then take the step S12, add a resin solution into nanoscale dispersing solution and stir the mixture evenly to form a colloidal mixture. The resin solution is prepared by heating and dissolving 10 g water-based PVA resin in 90 g aqueous solution. The mixture of the nanoscale dispersing solution and the resin solution is stirred evenly by a stirrer so as to form a colloidal mixture. The stirring time is 30 minutes.

Next run the step S14, heat and concentrate the colloidal mixture to get a conductive adhesive. The heating temperature is controlled at 80 degree Celsius. Continue stirring the mixture during heating processes until the viscosity has reached 1800 cp and then stop heating.

Figure 2:
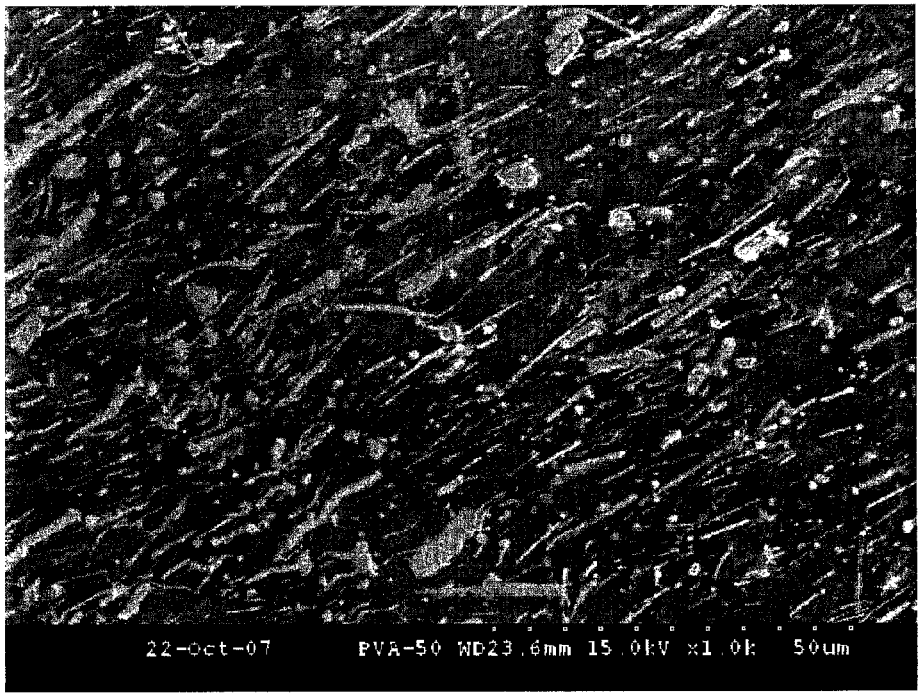
FIG. 2 is a scanning electron microscope image of an embodiment according to the present invention.

Refer to FIG. 2, a scanning electron microscope (SEM) image is revealed. As shown in figure, the conductive adhesive is coated on a substrate by a coating equipment and then is set into a furnace for curing so as to form a conductive film on the substrate. The thickness of the conductive film is controlled, ranging from 20 μm to 100 μm. Thus a conductive film with the thickness of 40 μm is formed on the substrate by using the conductive adhesive obtained in the embodiment one and the above steps. From the SEM image, it is learned that the conductive nanomaterial is dispersed well in the resin solution, and no obvious aggregates are observed. Then use a four point probe to measure surface electrical resistivity of the conductive film and the surface electrical resistivity of this embodiment is $3.20\times10^{-1}$ Ω/square.

Embodiment Two

Figure 3:
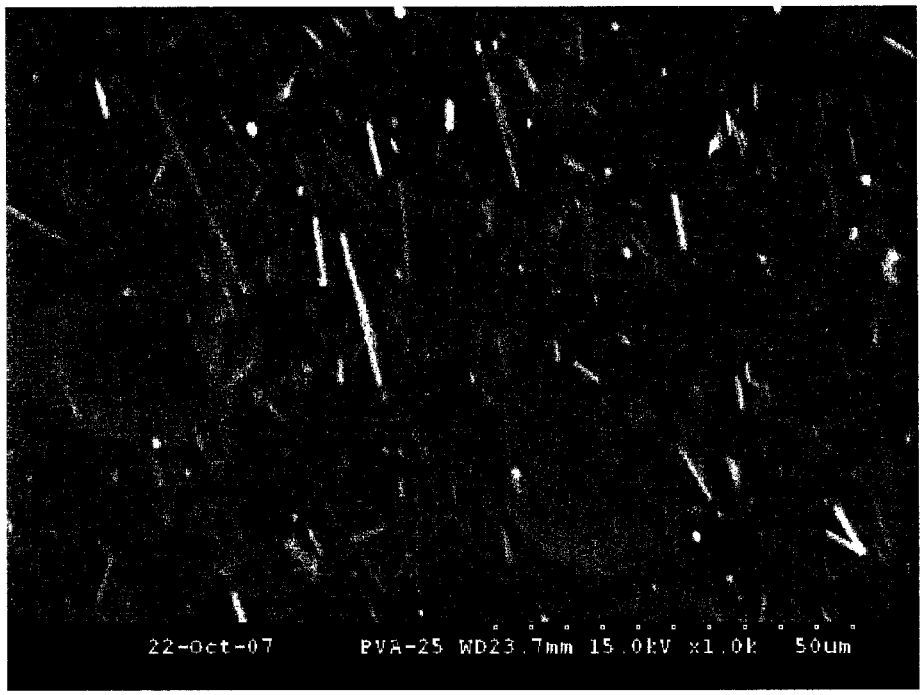
FIG. 3 is a scanning electron microscope image of another embodiment according to the present invention.

The difference between this embodiment and the embodiment one is in that the amount of conductive nanomaterial used is 50 g and a conductive adhesive is obtained according to the steps in the embodiment one. Refer to FIG. 3, a SEM image of the embodiment is disclosed. As shown in figure, in the conductive adhesive prepared with fewer amount of conductive nanomaterial, the conductive nanomaterial is dispersed well in the resin solution and no obvious aggregates are found. Next use a four point probe to measure surface electrical resistivity of the conductive film and the surface electrical resistivity of this embodiment is $4.89\times10^{12}$ Ω/square.

Embodiment Three

Figure 4:
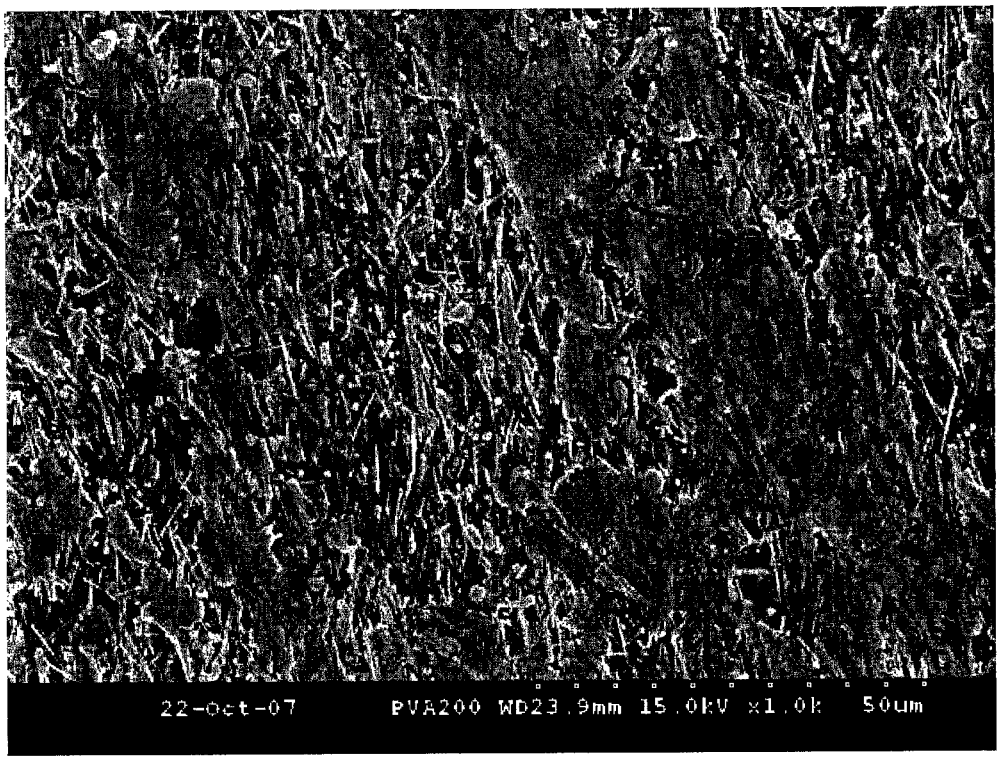
FIG. 4 is a scanning electron microscope image of a further embodiment according to the present invention.

The difference between this embodiment and the embodiment one is in that the amount of the conductive nanomaterial used is 400 g and a conductive adhesive is obtained according to the steps in the embodiment one. Refer to FIG. 4, a SEM image of the embodiment is revealed. As shown in figure, in the conductive adhesive prepared with different amount of conductive nanomaterial, the conductive nanomaterial is dispersed well in the resin solution, no obvious aggregates are present. Next use a four point probe to measure surface electrical resistivity of the conductive film and the surface electrical resistivity of this embodiment is $5.3\times10^{-2}$ Ω/square.

Figure 5:
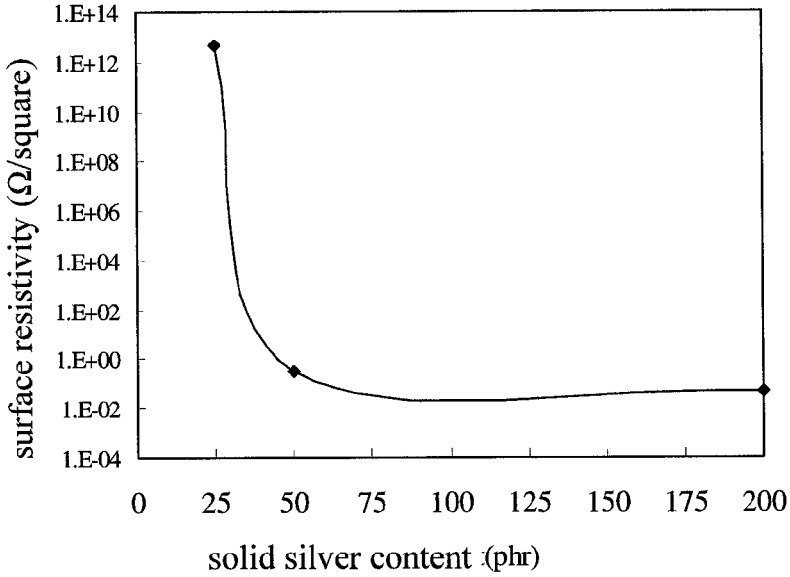
FIG. 5 shows a relationship between the surface electrical resistivity and the amount of conductive nanomaterial used of an embodiment according to the present invention.

The conductive adhesive in the above three embodiments is formed by a conductive nanomaterial and resin solution containing water-based resin. Refer to FIG. 2, FIG. 3 and FIG. 4, in the conductive adhesive of the above three embodiments, the conductive nanomaterial and the resin solution containing water-based resin are compatible with each other, without aggregation. The three embodiments have different amount of conductive nanomaterial and the surface electrical resistivity of the conductive adhesive is changed according to the amount of the conductive nanomaterial used. Refer to FIG. 5, the relationship between the surface electrical resistivity and the amount of the conductive nanomaterial used of an embodiment is revealed. As shown in figure, the higher amount of conductive nanomaterial is added, the higher solid silver content the conductive nanomaterial contains. On the other hand, the lower amount the conductive nanomaterial is used, the less solid silver content the conductive nanomaterial contains. From the above three embodiments, it is learned that the more conductive nanomaterial is used, the lower surface electrical resistivity of the conductive adhesive is and the better the conductivity of the conductive adhesive. That means the higher solid silver content the conductive nanomaterial contains, the better the conductivity of the conductive adhesive.

Figure 6:
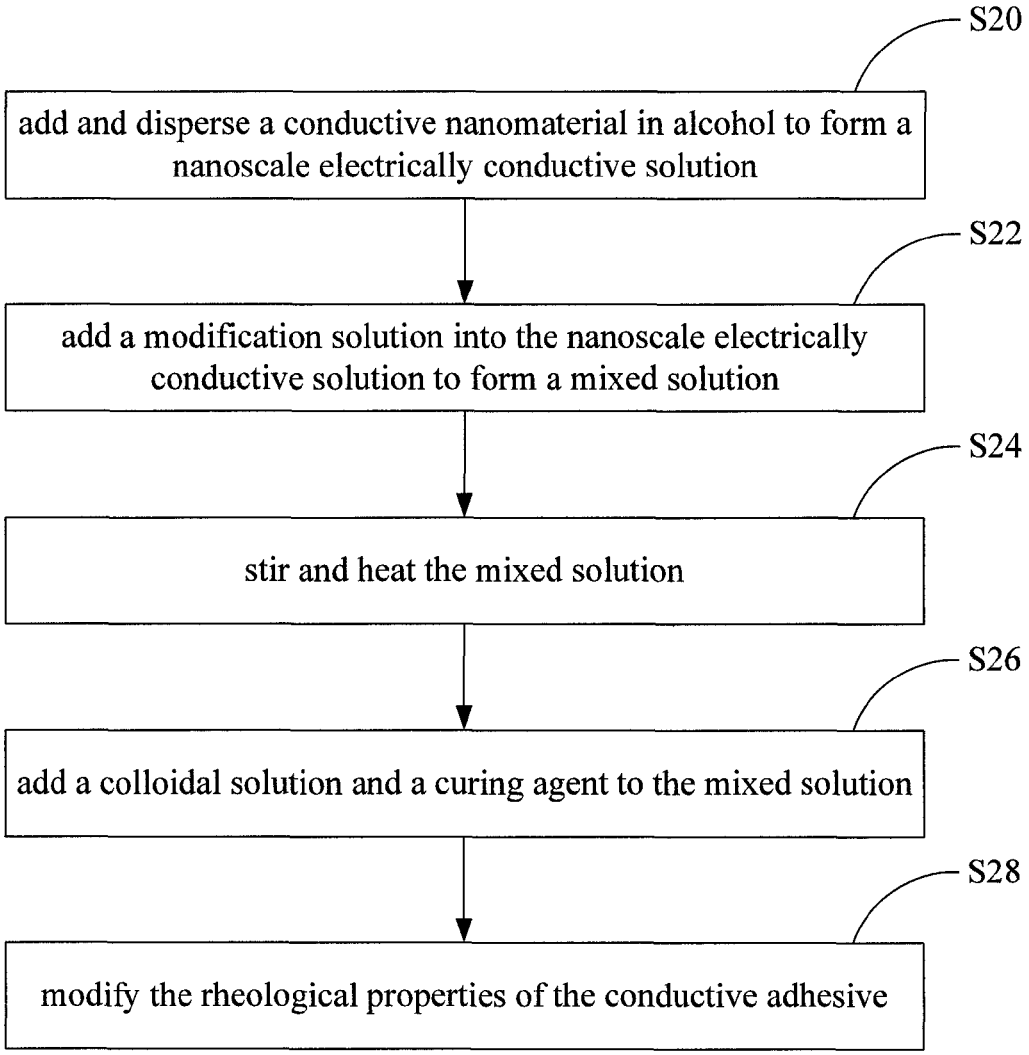
FIG. 6 is a flow chart of another embodiment according to the present invention.

Refer to FIG. 6, a flow chart of another embodiment according to the present invention is revealed. As shown in figure, this embodiment provides a method for manufacturing a conductive adhesive containing conductive nanomaterial. The resin solution in this embodiment includes an oleoresin (solvent-based resin) and a curing agent. In order to mix the resin solution containing oleoresin with conductive nanomaterial, a surface modifying agent is used for modification. At last, the rheological properties of the conductive adhesive are modified and adjusted. According to the method of the present invention, firstly, take the step S20, add and disperse a conductive nanomaterial in alcohol to form a nanoscale dispersing solution. The conductive nanomaterial is selected from silver, gold, copper, iron, nickel, tin, electrically conductive metal or electrically conductive metal oxide. The conductive nanomaterial can be in the form of nanowires, nanorods, nanopillars, or 1D nanostructured conductive material. Then run the step S22, add a modification solution into the nanoscale dispersing solution to form a mixed solution. The modification solution consists of a surface modifying agent, or a mixture of a surface modifying agent with acetone. The surface modifying agent can be silane surface modifying agent containing silane groups and hydrophilic groups, or a surface modifying agent containing borane groups and hydrophilic groups.

Next take the step S24, stir and heat the mixed solution. Refer to the step S26, add a resin solution and a curing agent to the mixed solution. Stir and mix the mixed solution, the resin solution and the curing agent evenly to form a conductive adhesive. The resin solution is prepared by mixing a resin with an aqueous solution while the resin can be water-based resin or solvent-based resin. Finally, take the step S28, modify the rheological properties of the conductive adhesive. The rheological properties are modified by adding a thixotropic agent or a thickening agent into the conductive adhesive. The followings are embodiment of conductive adhesives formed by conductive nanomaterials and resin solution containing oleoresin.

Embodiment Four

This embodiment produces a conductive adhesive according to the above steps. In this embodiment, the conductive nanomaterial is silver, the conductive nanomaterial is in the form of nanowires. The oleoresin and the curing agent in the resin solution are respectively epoxy and BDMA (benzyl dimethyl amine). Back to FIG. 6, a method for manufacturing a conductive adhesive of this embodiment takes the step S20 in the beginning. Add and disperse 100 g conductive nanomaterial (silver nanowire) in ethanol to form a nanoscale dispersing solution. The solid silver content of the nanoscale dispersing solution is 5% by weight. While adding conductive nanomaterial into ethanol, the dispersion is enhanced in an ultrasonic tank for about 20 minutes.

Then run the step S22, add a modification solution into the nanoscale dispersing solution to form a mixed solution. The modification solution is formed by mixing 0.05 g silane surface modifying agent a surface modifying agent, or a mixture of a surface modifying agent with 10 g acetone. Next take the step S24, stir and heat the mixed solution. After stirring and mixed solution evenly, heat for removing ethanol and acetone from the mixed solution.

Take the step S26, add a resin solution into the mixed solution and stir the resin solution and the mixed solution evenly to form a colloidal mixture. The resin solution is prepared by 10 g solvent epoxy resin mixed with BDMA. The mixture of the mixed solution and the resin solution is stirred evenly by a stirrer so as to form a colloidal mixture. The stirring time is 30 minutes. The last step is S28, modify the rheological properties of the conductive adhesive. In this embodiment, 0.05 g diluted thixotropic agent is added for modifying the rheological properties.

Figure 7:
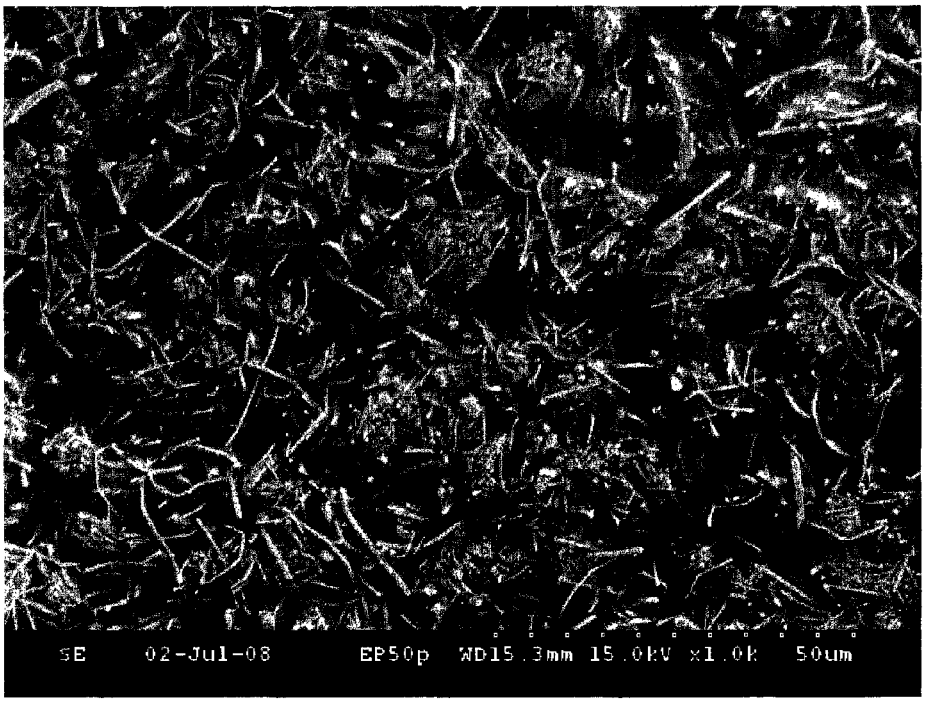
FIG. 7 is a scanning electron microscope image of an embodiment according to the present invention.

Refer to FIG. 7, a SEM image of a further embodiment is revealed. As shown in figure, the product of conductive adhesive is coated on a substrate by a coating equipment and then is put into a furnace for curing so as to form a conductive film on the substrate. The thickness of the conductive film is controlled between 20 μm and 100 μm. Thus a conductive film with the thickness of 40 μm is formed on the substrate by using the conductive adhesive obtained in the embodiment four and the above steps. From the SEM image, it is learned that the conductive nanomaterial and the resin solution are dispersed well, and no obvious aggregates are observed. Then use a four point probe to measure surface electrical resistivity of the conductive film and the surface electrical resistivity of this embodiment is $4.8\times10^{1}$ Ω/square.

Embodiment Five

The difference between this embodiment and the above one is in that no modification solution is added in this embodiment while other steps and conditions are the same. When the nanoscale dispersing solution and the resin solution are mixed and stirred, the conductive nanomaterial and the resin solution can not be mixed well and are separated from each other. There is no strong aggregation of the conductive nanomaterial observed. Although there is still an adhesive obtained, the four point probe is unable to measure the surface electrical resistivity of the adhesive. This means that the adhesive obtained without addition of the surface modifying agent has poor electrical conductivity.

Embodiment Six

Figure 8:
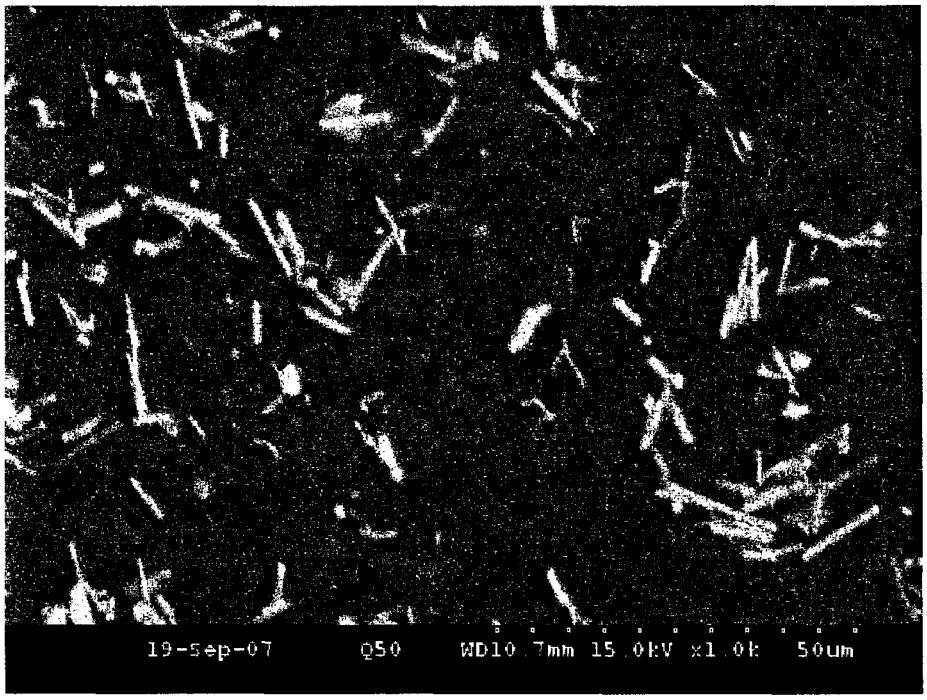
FIG. 8 is a scanning electron microscope image of another embodiment according to the present invention.

Compared with the embodiment four, the oleoresin and the surface modifying agent are directly mixed for 60 minutes and then add nanoscale dispersing solution into the mixture in this embodiment. Stir and heat the mixture to get a conductive adhesive. Refer to FIG. 8, a SEM image of a further embodiment is shown. As shown in figure, use a scanning electron microscope to observe a conductive film formed by coating the conductive adhesive on the substrate. It is found that the conductive nanomaterial and the oleoresin are dispersed adequately and no obvious aggregates are observed. Moreover, use a four point probe to measure surface electrical resistivity of the conductive film and the surface electrical resistivity is $1.1\times10^{11}$ Ω/square. In this embodiment, the oleoresin is modified firstly and then is mixed with conductive nanomaterial. Although the dispersion of the conductive nanomaterial and oleoresin in the conductive adhesive is not bad, the conductivity of the conductive adhesive in this embodiment is not as good as that of the conductive adhesive in the embodiment four.

Embodiment Seven

The difference between this embodiment and the embodiment four is in that the amount of the conductive nanomaterial is 150 g and the modification solution is formed by mixing 0.075 g silane surface modifying agent with 10 g acetone while other conditions are the same. There is no obvious aggregation observed in a conductive film formed by a conductive adhesive in this embodiment being coated on a substrate. Use a four point probe to measure surface electrical resistivity of the conductive film of this embodiment and the surface electrical resistivity is $2.2\times10^{0}$ Ω/square.

Embodiment Eight

Figure 9:
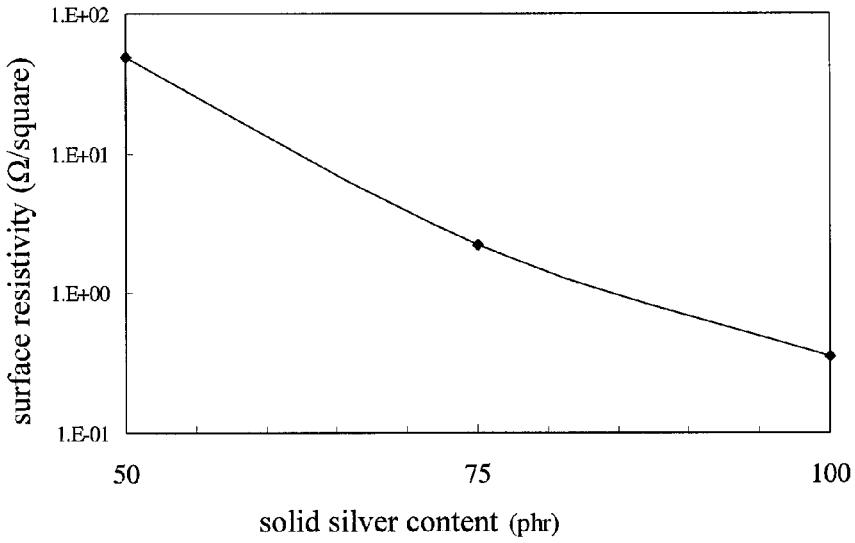
FIG. 9 shows a relationship between the solid silver content of the conductive nanomaterial and the surface electrical resistivity of another embodiment according to the present invention.

The difference between this embodiment and the embodiment four is in that the amount of the conductive nanomaterial is 200 g and the modification solution is formed by mixing 0.1 g silane surface modifying agent with 10 g acetone while other conditions are the same. There is no obvious aggregation observed in a conductive film formed by a conductive adhesive in this embodiment being coated on a substrate. Use a four point probe to measure surface electrical resistivity of the conductive film of this embodiment and the surface electrical resistivity is $4.5\times10^{-1}$ Ω/square. Refer to FIG. 9, the figure shows a relationship between the solid silver content of the conductive nanomaterial and the surface electrical resistivity of another embodiment according to the present invention. The FIG. 9 is drawn according to the solid silver content used and the surface electrical resistivity of the conductive film produced in the embodiment four, embodiment seven and embodiment eight. Thus the higher the solid silver content, the lower surface electrical resistivity the conductive film has. That means the conductive film has better conductivity.

Embodiment Nine

Compared with the embodiment one, the difference between this embodiment and the embodiment one is in the form of the conductive nanomaterial used. This embodiment uses 100 g silver nanoparticles dispersed in ethanol while other conditions are the same. There is no obvious aggregation observed in the conductive adhesive of this embodiment. The conductive adhesive of this embodiment is coated on a substrate to form a conductive film. Then use a four point probe to measure surface electrical resistivity of the conductive film and the surface electrical resistivity is $5.0\times10^{7}$ Ω/square.

Embodiment Ten

The difference between this embodiment and the embodiment one is in the form of the conductive nanomaterial used. This embodiment uses 200 g silver nanoparticles dispersed in ethanol while other conditions are the same. There is no obvious aggregation observed in the conductive adhesive of this embodiment. The conductive adhesive of this embodiment is coated on a substrate to form a conductive film. Then use a four point probe to measure surface electrical resistivity of the conductive film and the surface electrical resistivity is $4.4\times10^{0}$ Ω/square.

Embodiment Eleven

Figure 10:
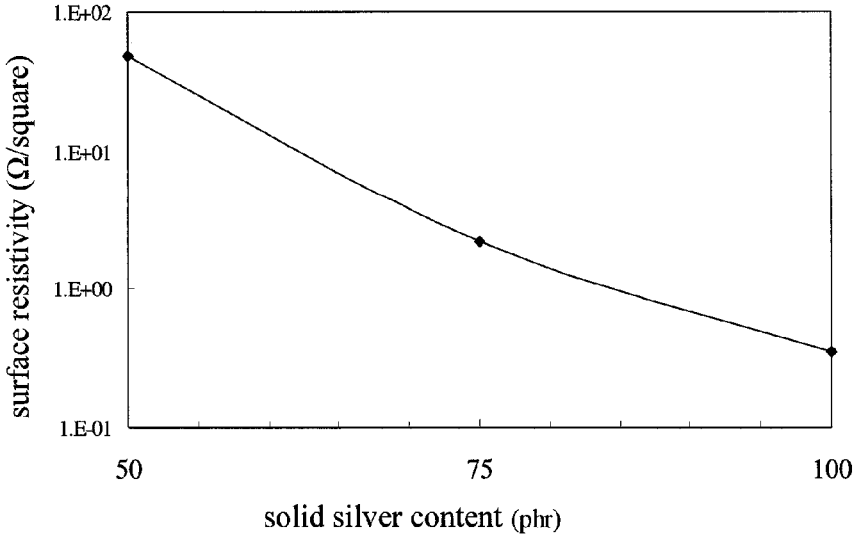
FIG. 10 shows a relationship between the solid silver content of the conductive nanomaterial and the surface electrical resistivity of a further embodiment according to the present invention.

The difference between this embodiment and the embodiment one is in the form of the conductive nanomaterial used. This embodiment uses 800 g silver nanoparticles dispersed in ethanol while other conditions are the same. There is no obvious aggregation observed in the conductive adhesive of this embodiment. The conductive adhesive of this embodiment is coated on a substrate to form a conductive film. Then use a four point probe to measure surface electrical resistivity of the conductive film and the surface electrical resistivity is $3.3\times10^{-1}$ Ω/square. Refer to FIG. 10, the figure shows a relationship between the solid silver content of the conductive nanomaterial and the surface electrical resistivity of a further embodiment according to the present invention. The FIG. 10 is drawn according to the solid silver content of silver nanoparticles and the surface electrical resistivity of the conductive film produced in the embodiment nine, embodiment ten and embodiment eleven. Thus the higher the solid silver content (the more conductive nanomaterial used), the lower surface electrical resistivity the conductive film has. That means the conductive film has better conductivity. Next compare the embodiment one with the embodiment eleven. Both the embodiment one and the embodiment eleven mix a conductive nanomaterial with a resin solution containing water-based resin. The surface electrical resistivity of the condtuvie film formed in the embodiment one with 100 g silver nanowire is similar to that of the condtuvie film produced in the embodiment eleven with 800 g silver nanoparticles. Yet the weight of the silver nanowires used is only one eighth (⅛) of the weight of the silver nanoparticles used.

Embodiment Twelve

Use the steps in the embodiment four while the difference between this embodiment and the embodiment four is in the form of the conductive nanomaterial used. This embodiment uses 200 g silver nanoparticles dispersed in ethanol while other conditions are the same. There is no obvious aggregation observed in the conductive adhesive of this embodiment. The conductive adhesive of this embodiment is coated on a substrate to form a conductive film. Then use a four point probe to measure surface electrical resistivity of the conductive film and the surface electrical resistivity is $1\times10^{13}$ Ω/square.

Embodiment Thirteen

Use the steps in the embodiment four while the difference between this embodiment and the embodiment four is in the form of the conductive nanomaterial used. This embodiment uses 400 g silver nanoparticles dispersed in ethanol while other conditions are the same. There is no obvious aggregation observed in the conductive adhesive of this embodiment. The conductive adhesive of this embodiment is coated on a substrate to form a conductive film. Then use a four point probe to measure surface electrical resistivity of the conductive film and the surface electrical resistivity is $5\times10^{2}$ Ω/square.

Embodiment Fourteen

Figure 11:
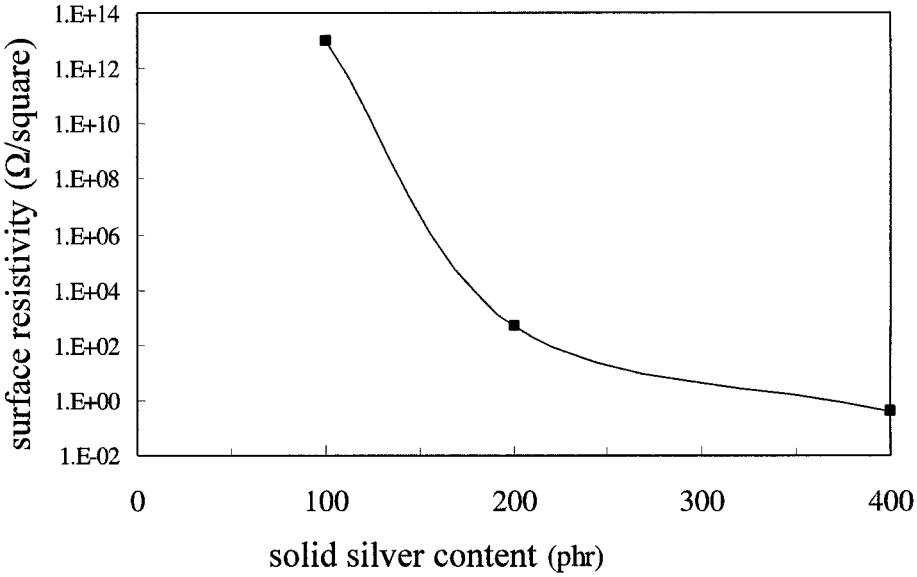
FIG. 11 shows a relationship between the solid silver content of the conductive nanomaterial and the surface electrical resistivity of a further embodiment according to the present invention.
Figure 12:
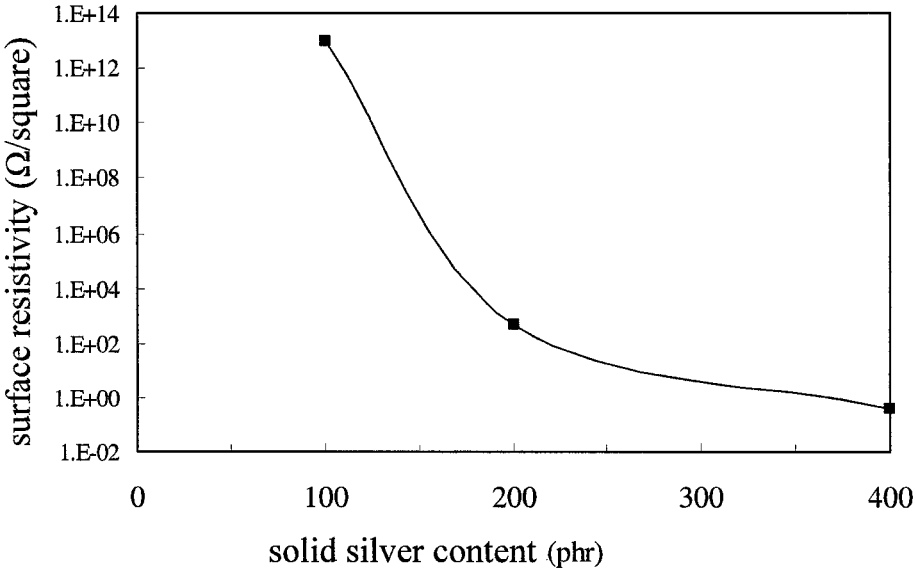
FIG. 12 shows a relationship between the solid silver content of the conductive nanomaterial and the surface electrical resistivity of a further embodiment according to the present invention.

Use the steps in the embodiment four while the difference between this embodiment and the embodiment four is in the form of the conductive nanomaterial used. This embodiment uses 800 g silver nanoparticles dispersed in ethanol while other conditions are the same. There is no obvious aggregation observed in the conductive adhesive of this embodiment. The conductive adhesive of this embodiment is coated on a substrate to form a conductive film. Then use a four point probe to measure surface electrical resistivity of the conductive film and the surface electrical resistivity is $3.8\times10^{-1}$ Ω/square. Refer to FIG. 11, the figure shows a relationship between the solid silver content of the conductive nanomaterial and the surface electrical resistivity of a further embodiment according to the present invention. The FIG. 11 is drawn according to the solid silver content of silver nanoparticles and the surface electrical resistivity of the conductive film produced in the embodiment twelve, embodiment thirteen and embodiment fourteen. Thus the higher the solid silver content (the more conductive nanomaterial used), the lower surface electrical resistivity the conductive film has. That means the conductive film has better conductivity. Next compare the embodiment eight with the embodiment fourteen. Both the embodiment eight and the embodiment fourteen mix the conductive nanomaterial with the resin solution containing solvent based resin. The surface electrical resistivity of the conductive film having 200 g silver nanowires of the embodiment eight is similar to that of the conductive film having 800 g silver nanoparticles of the embodiment fourteen but the amount of the silver nanowires used is only one fourth (¼) of the amount of the silver nanoparticles used.

In summary, the present invention provides a method for manufacturing a conductive adhesive containing a conductive nanomaterial in which a 1D conductive nanomaterial is mixed with water-based or solvent-based resin solution. 1D conductive nanomaterials have high aspect ratio and excellent conductivity. Thus they also have good physical properties and electron transport properties. Therefore the amount of conductive nanomaterial used is dramatically reduced. Moreover, the conductive adhesive manufactured by the present invention is observed and analyzed by an electron microscope. The results show that the conductive adhesive has been modified and the conductive nanomaterial is dispersed in colloidal evenly. The present invention provides a technique that mixes 1D conductive nanomaterials with colloids having different properties. The technique has high industrial applicability.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A method for manufacturing a conductive adhesive containing at least one one-dimensional (1D) conductive nanomaterial comprising the steps of:

adding and dispersing at least one conductive nanomaterial into ethanol to form a nanoscale dispersing solution; the conductive nanomaterial is in the form of nanowires, nanotubes, nanorods, or conductive material with 1D nanostructure;

adding a modification solution to the nanoscale dispersing solution to form a mixed solution;

then stirring and heating the mixed solution;

adding a resin solution to the mixed solution and mixing the mixed solution with the resin solution evenly to get a conductive adhesive; and modifying rheological properties of the conductive adhesive;

Wherein the modification solution is used to change the surface properties of the nanomaterial for dispersing the nanomateiral in the resin solution with no aggregation and adjusting surface electrical resistivity of the conductive adhesive, the modification solution including a surface modifying agent mixed with acetone.

2. The method as claimed in claim 1, wherein the conductive nanomaterial is selected from silver, gold, copper, iron, nickel, tin, electrically conductive metal or electrically conductive metal oxide.

3. The method as claimed in claim 1, wherein the surface modifying agent that is a silane surface modifying agent or a borane surface modifying agent and the silane surface modifying agent comprises silane groups and hydrophilic groups while the borane surface modifying agent contains borane groups and hydrophilic groups.

4. The method as claimed in claim 1, wherein solid content of the conductive nanomaterial ranges from 1 phr to 400 phr.

5. The method as claimed in claim 1, wherein the resin solution includes a solvent-based resin and a curing agent.

6. The method as claimed in claim 1, wherein in the step of modifying rheological properties of the conductive adhesive, a thixotropic agent or a thickening agent is added for modifying the rheological properties of the conductive adhesive.

* * * * *